United States Patent [19]

Wessner

[11] 4,452,471

[45] Jun. 5, 1984

[54] MEMORY BOOK

[75] Inventor: Richard A. Wessner, Providence, R.I.

[73] Assignee: Reed & Barton Corporation, Taunton, Mass.

[21] Appl. No.: 339,398

[22] Filed: Jan. 15, 1982

[51] Int. Cl.[3] ..... B42D 3/08; B42D 17/00

[52] U.S. Cl. ..... 281/48; 281/15 A; 281/17; 281/19 R

[58] Field of Search ..... 281/45, 46, 47, 48, 281/49, 50, 15 A, 17, 19 R, 19 A, 22, 1, 3 R, 4, 16, 19, 29, 28, 30, 34

[56] References Cited

U.S. PATENT DOCUMENTS

| | | | |
|---|---|---|---|
| 1,377,120 | 5/1921 | Exline | 281/19 R |
| 1,422,696 | 7/1922 | Goodyear | 281/48 |
| 1,665,641 | 4/1928 | Reese | 281/47 |
| 1,999,583 | 4/1935 | Bouvier | 281/42 |
| 2,572,703 | 10/1951 | Dennis | 281/1 |
| 3,734,155 | 5/1973 | Stenger | 281/46 X |
| 3,822,446 | 7/1974 | Silverstein | 281/49 X |
| 4,248,657 | 2/1981 | Henry | 412/17 X |

*Primary Examiner*—E. R. Kazenske
*Assistant Examiner*—Taylor J. Ross
*Attorney, Agent, or Firm*—Thompson, Birch

[57] ABSTRACT

A book-type ornament adapted to be suspended from a Christmas tree bough or other like support has a plurality of pliant inner sheets folded on themselves to provide pages. A pliant outer sheet is folded on itself to provide top and bottom cover portions, with the pages being arranged therebetween, and with the fold lines of the inner and outer sheets being parallel and adjacent to one another. A flexible elongated element is received in aligned openings located at the fold lines of the inner and outer sheets. This element extends exteriorly of the fold line of the outer sheet to form a loop for suspending the ornament. Planar outer elements overlie the exterior surfaces of the cover portions. The outer elements, which are dimensioned to expose the fold line of the outer sheet, have inturned peripheral flanges overlapping the edges of the cover portions.

2 Claims, 4 Drawing Figures

MEMORY BOOK

BACKGROUND OF THE INVENTION

This invention relates to ornaments of the type adapted to be suspended from the boughs of Christmas trees.

Conventional Christmas tree ornaments traditionally are exclusively decorative, and thus serve no functional purpose. The objective of the present invention is the provision of an ornament which not only is attractive in appearance, but which also functions as a register in which entries of the names of house guests, listings of gifts, etc. can be entered and preserved for future reference. Other objects and advantages of the present invention will become evident as the description proceeds with the aid of the accompanying drawings, wherein.

Figure 1:
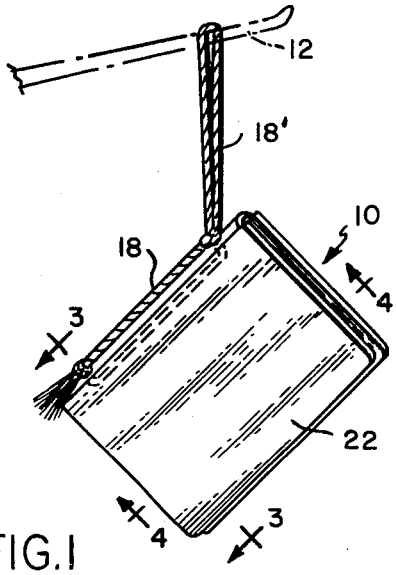
FIG. 1 is a perspective view of an ornament in accordance with the present invention.
Figure 3:
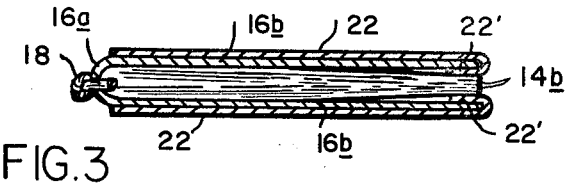
Figure 4:
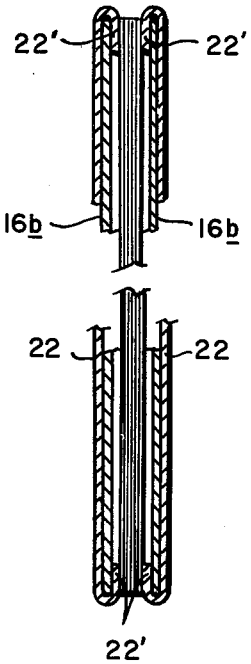
Figure 2:
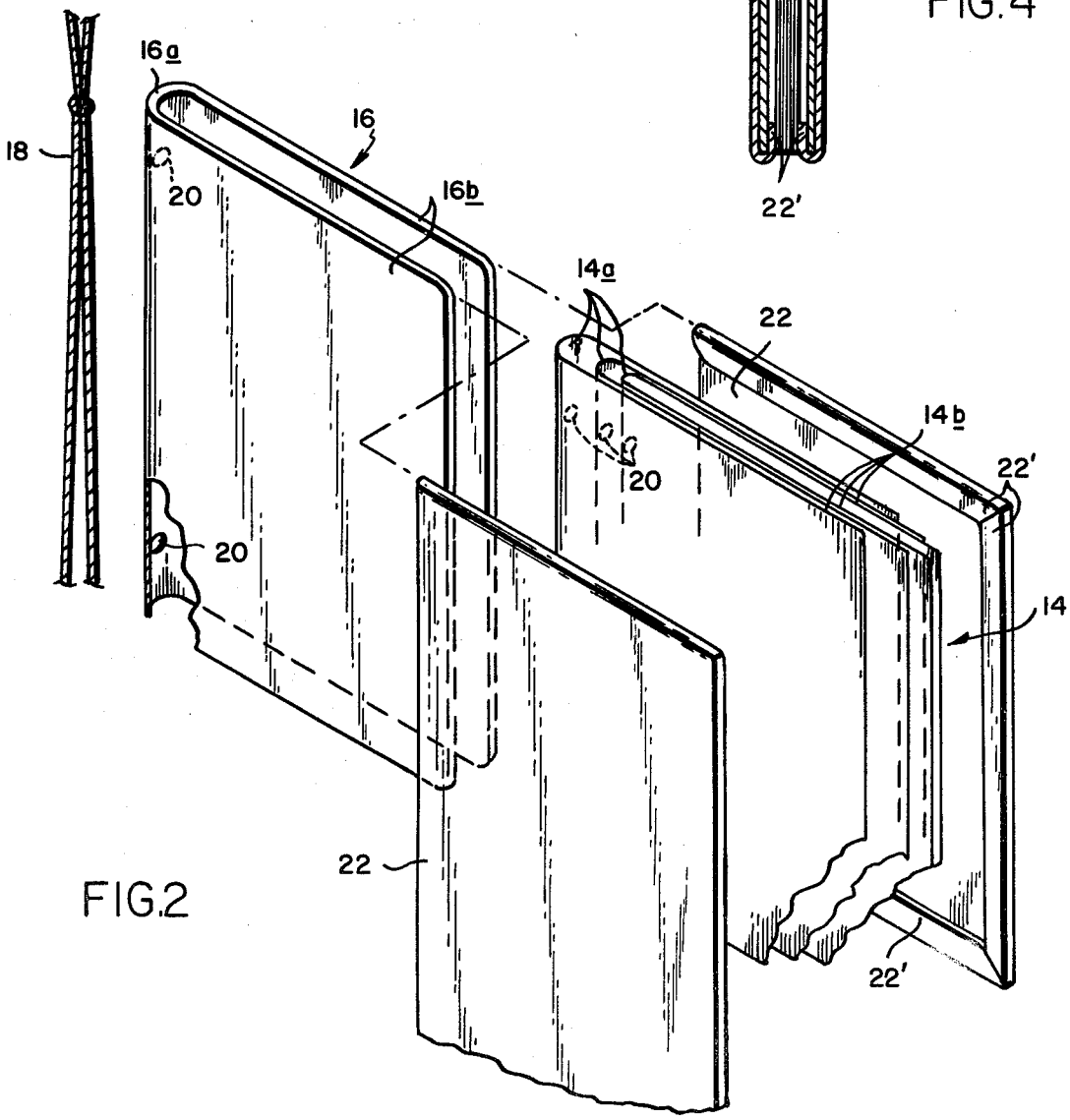
FIG. 2 is an exploded perspective view of the ornament.

FIGS. 3 and 4 are sectional views on an enlarged scale taken along lines 3—3 and 4—4 of FIG. 1.

In FIG. 1, an ornament in accordance with the present invention is generally indicated at 10 suspended from the bough 12 of a Christmas tree. The ornament 10 includes a plurality of pliant inner sheets 14 folded on themselves along fold lines 14*a* to provide pages 14*b*. An outer pliant sheet 16 is folded on itself along a fold line 16*a* to provide top and bottom cover portions 16*b*. The pages 14*b* are arranged between the cover portions 16*b* with the fold lines 14*a*, 16*a* parallel and adjacent to one another.

A flexible elongated element such as for example a decorative cord 18 is received in aligned openings 20 located at the fold lines 14*a*, 16*a* of the inner and outer sheets 14, 16. The cord 18 provides the means for joining the inner and outer sheets together, and it extends exteriorly of the outer sheet 16 to form a loop 18' which also provides the means for suspending the ornament as shown in FIG. 1.

The inner sheets 14 are preferably made of paper, parchment or the like, and the outer sheet 16 can consist of either a thicker paper, leather, plastic or other like material which is somewhat less pliant than the inner sheets.

Planar outer elements 22 overlie the exterior surfaces of the cover portions 16*b*. The elements 22 are appropriately dimensioned to expose the fold line 16*a* and adjacent portions of the outer sheet 16. The elements 22 are rigid and have inturned peripheral flanges 22' overlapping the edges of the cover portions 16*b*.

The elements 22 are preferably fabricated from rolled metal sheet stock, and can if desired be decoratively plated with precious metal, for example sterling silver or gold.

The visual contrast between the exposed portions of the outer sheet 16 and the outer elements 22, in combination with the cord 18 which can also have a contrasting color, provides a highly decorative and pleasing appearance. Names of house guests, a listing of gifts, etc. can be entered on the pages 14*b* and preserved for future reference each time the ornament is reused on successive holidays.

I claim:

1. A book-type ornament adapted to be suspended from a Christmas tree bough or other like support, comprising:

a plurality of pliant inner sheets folded on themselves to provide pages;

a pliant outer sheet folded on itself to provide top and bottom cover portions, said pages being arranged between said cover portions with the fold lines of said inner and outer sheets being parallel and adjacent to each other;

flexible elongated means received in aligned openings located at the fold lines of said inner and outer sheets, said means extending exteriorily of the fold line of said outer sheet to form a loop for suspending said ornament; and a planar outer element overlying the exterior surface of each of said cover portions, said outer elements being dimensioned to expose the fold line of said outer sheet, each of said outer elements having inturned peripheral flanges, around a portion of the periphery thereof, overlapping the edges of a respective one of said cover portions, said outer elements being metallic and said inner and outer sheets being non-metallic.

2. The ornament of claim 1 wherein said outer sheet is less pliant than said inner sheets, and wherein said outer elements are rigid.

* * * * *